US005833574A

United States Patent [19]

Hsieh

[11] Patent Number: 5,833,574

[45] Date of Patent: Nov. 10, 1998

[54] WALKING-TYPE EXERCISER

[76] Inventor: Chao-Mao Hsieh, No. 71, Nan An Rd., Tian Liao Hsiang, Kaohsung Hsian, Taiwan

[21] Appl. No.: 806,330

[22] Filed: Feb. 26, 1997

[51] Int. Cl.[6] ..... A63B 22/00

[52] U.S. Cl. ..... 482/51; 434/255; 482/74

[58] Field of Search ..... 482/51, 52, 53, 482/70, 54, 57, 74, 148, 114, 115, 118; 434/255, 247; 601/33, 35

[56] References Cited

U.S. PATENT DOCUMENTS

| | | | |
|---|---|---|---|
| 4,850,585 | 7/1989 | Dalebout | 482/51 |
| 5,374,225 | 12/1994 | Wilkinson | 482/118 |
| 5,419,747 | 5/1995 | Piaget et al. | 482/70 |
| 5,496,235 | 3/1996 | Stevens | 482/51 |
| 5,605,521 | 2/1997 | Hsieh | 482/52 |
| 5,613,924 | 3/1997 | Lee | 482/51 |
| 5,616,103 | 4/1997 | Lee | 482/51 |
| 5,624,354 | 4/1997 | Chen | 482/51 |

*Primary Examiner*—Stephen R. Crow
*Attorney, Agent, or Firm*—Morton J. Rosenberg; David I. Klein; Jun Y. Lee

[57] ABSTRACT

A walking-type exerciser including two mounting seats, a detachable first supporting frame member connected to the mounting seats, a second supporting frame member detachably attached to the mounting seats, a handle detachably connected to the mounting seats, and two rocking devices detachably mounted to the mounting seats.

6 Claims, 4 Drawing Sheets

WALKING-TYPE EXERCISER

BACKGROUND OF THE INVENTION

1. Field of the Invention

The present invention relates to an improved walking-type exerciser the resistance of which may be adjusted to meet the user's need. The present invention also relates to a walking-type exerciser which can be detached for storage and easy carriage when not in use.

2. Description of the Related Art

Walking type exerciser is a useful indoor exerciser for modern people, and a typical one, as shown in FIG. 4 of the drawings, generally includes a substantially Z-shaped frame 51 having a handle portion 511, two rocking rods 52 pivotally attached to two sides of the frame 51 by pivotal axles 512, and two pedals 53 respectively mounted to lower ends of the rocking rods 52. The user may step on the pedals 53 and force the rocking rods 52 to rock alternatively by his/her legs, thereby achieving a walking-like effect. Nevertheless, the above-mentioned exerciser cannot provide various resistances. In addition, the exerciser is bulky as the Z-shaped frame 51 is not detachable, resulting in inconvenience to storage. The present invention is intended to provide an improved walking-type structure which mitigates and/or obviates the above problems.

SUMMARY OF THE INVENTION

It is an object of the present invention to provide a walking-type exerciser the resistance of which may be adjusted to meet the user's need.

It is a further object of the present invention to provide a walking-type exerciser which can be detached for storage and easy carriage when not in use.

A walking-type exerciser in accordance with the present invention comprises:

two mounting seats each including a receiving tube and a positioning hole, a first supporting frame member including a first ground bar having two ends and a pair of first supporting members respectively, detachably attached to the two ends of the first ground bar at lower ends thereof, each first supporting member further including an upper end securely attached to the associated mounting seat, a second frame member including a second ground bar having two ends and a pair of second supporting members respectively, detachably attached to the two ends of the second ground bar at lower ends thereof, each second supporting member further including an upper end detachably attached to the associated mounting seat, a handle including a pair of side beams each having a first end detachably attached to the associated mounting seat and a second end, the handle further including a substantially U-shaped member having two ends respectively, detachably connected to the second ends of the side beams, and two rocking means each including:

a sleeve fittingly received in the receiving tube of the associated mounting seat, the sleeve including an end wall, a rocking rod having a pedal detachably mounted to a lower end thereof, the rocking further including an engaging tube mounted to an upper end thereof, the engaging tube being mounted juxtaposed to and in alignment with the sleeve, an axle tube extending through the engaging tube and the sleeve, the axle tube including a first end having a diameter greater than an inner diameter of the sleeve and a second end received in the sleeve, the first end of the axle tube including a recess defined therein, the axle tube further including a longitudinal through hole, a bolt extending through the axle tube and having a first end and a second end, the second end of the bolt extending beyond the second end of the sleeve, the bolt having a head received in the recess of the axle tube, a spring mounted in the sleeve and around the bolt, the spring having a first end bearing against the second end of the axle tube and a second end bearing against the end wall of the sleeve, a positioning pin extending from the axle tube and having an end received in the positioning hole of the associated mounting seat to prevent rotational movement of the axle tube, and a nut mounted to the second end of the bolt, whereby a rotation of said nut causes a change in a resistance of the rocking means.

Preferably, washers may be mounted between each nut and the end wall of the associated sleeve, between each spring and the end wall of the associated sleeve, and mounted to two sides of each axle tube. A knob may be mounted to each nut to rotate therewith.

In an embodiment of the invention, a transverse hole is defined in the transverse tube, a corresponding screw hole is defined in the bolt, and a screw extends through the transverse hole and the screw hole to position the bolt.

Other objects, advantages, and novel features of the invention will become more apparent from the following detailed description when taken in conjunction with the accompanying drawings.

DESCRIPTION OF THE PREFERRED EMBODIMENT

Figure 1:
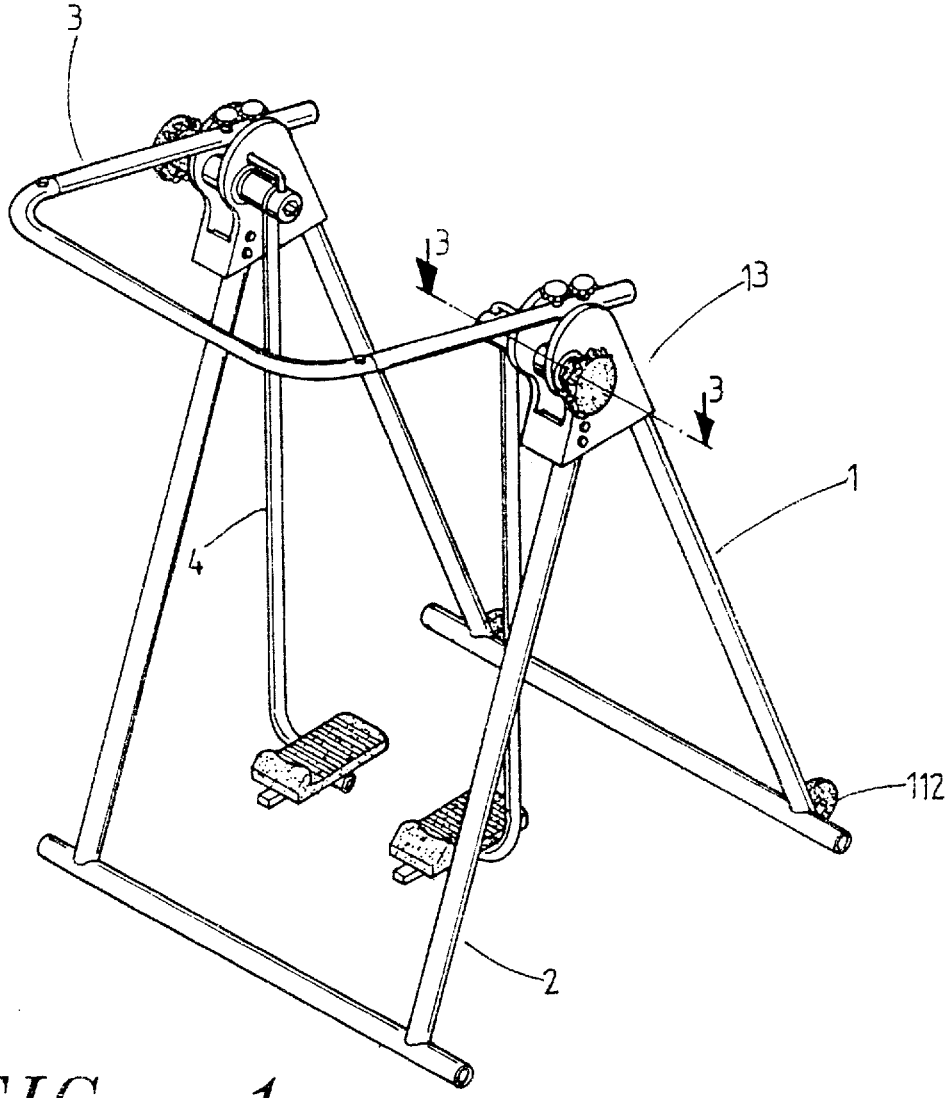
FIG. 1 is a perspective view of a walking-type exerciser in accordance with the present invention.
Figure 2:
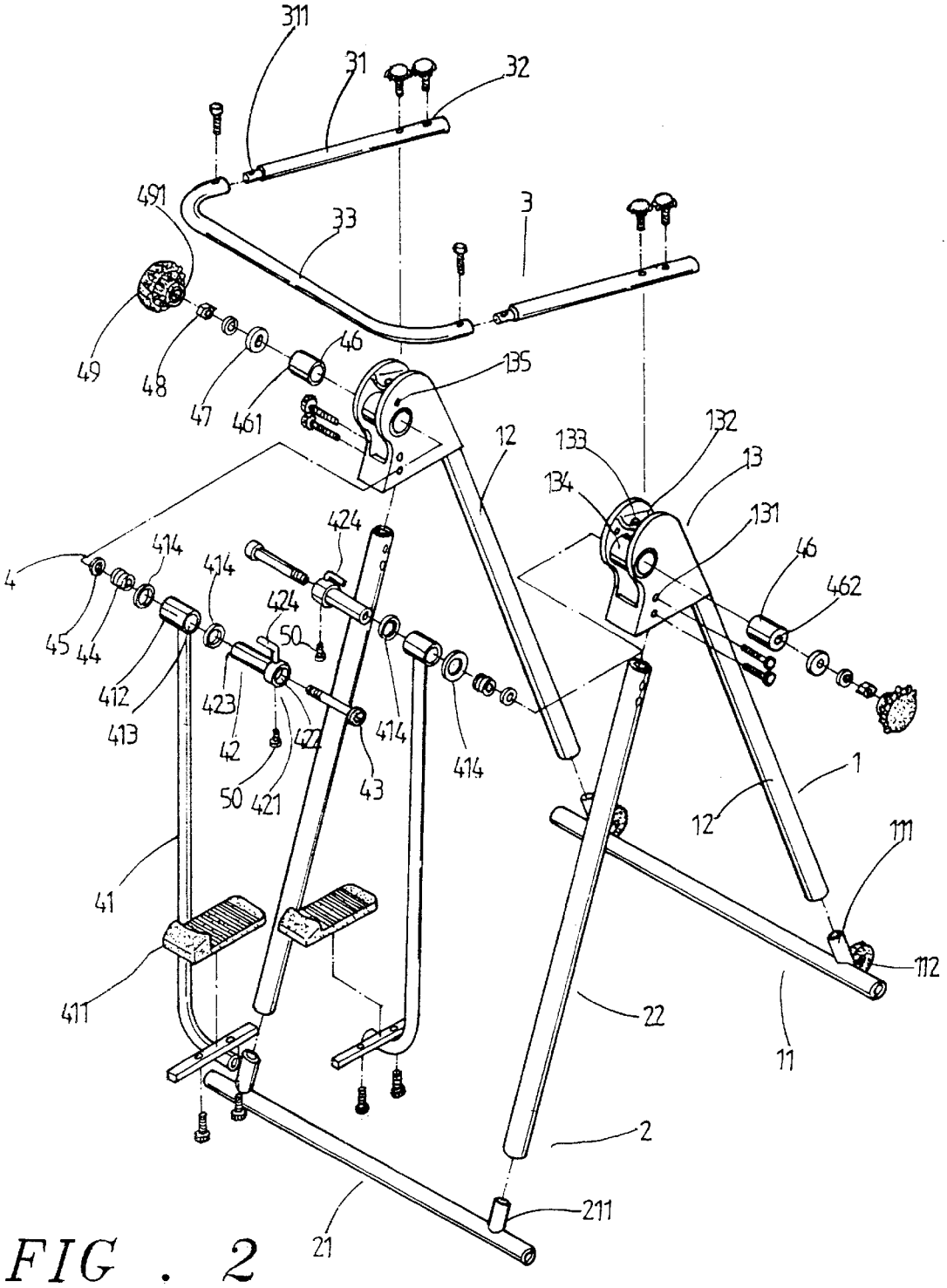
FIG. 2 is an exploded view of the walking-type exerciser in accordance with the present invention.
Figure 3:
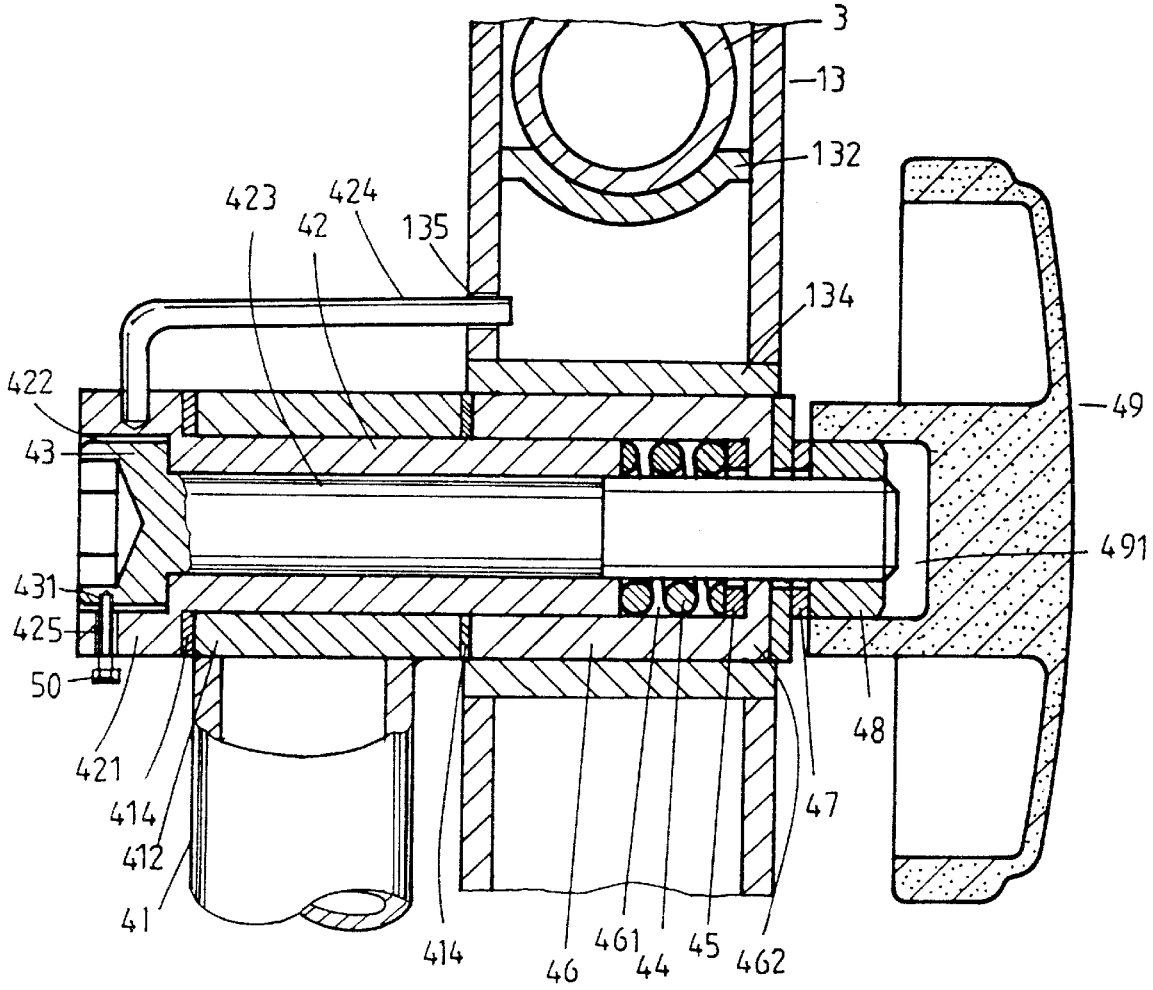
FIG. 3 is a cross-sectional view taken along line 3—3 of FIG. 1.
Figure 4:
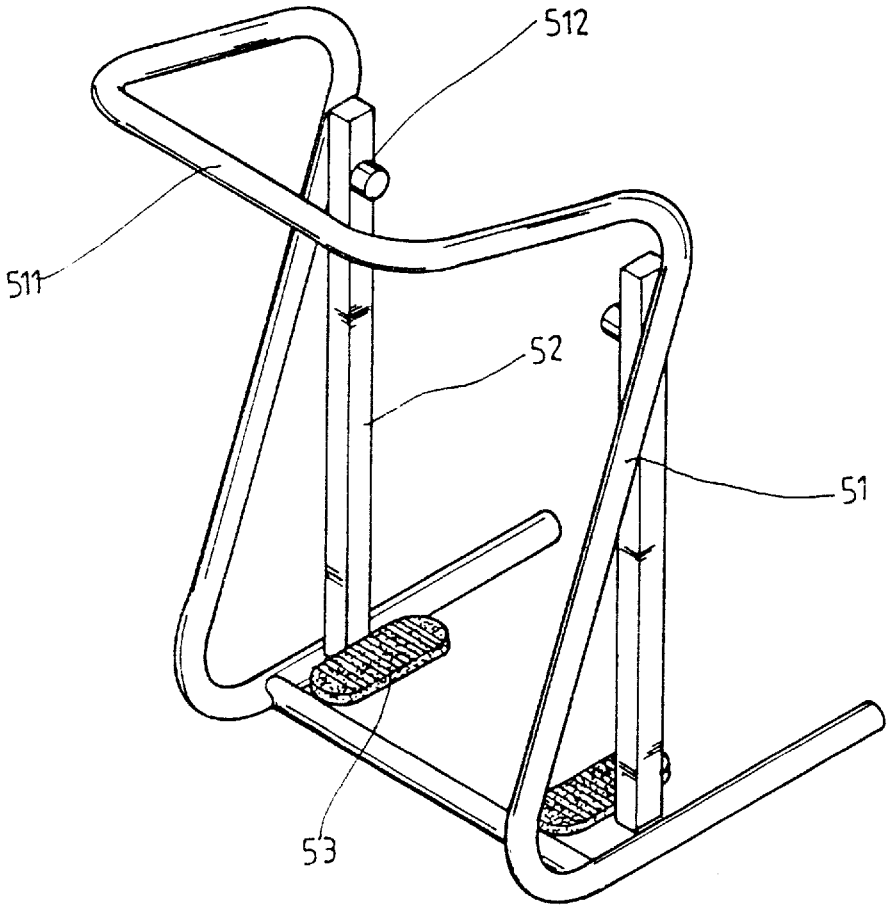
FIG . 4 PRIOR ART
FIG. 4 is a perspective view illustrating a conventional walking-type exerciser.

Referring to FIGS. 1 to 3 of the drawings and initially to FIGS. 1 and 2, a walking-type exerciser in accordance with the present invention generally includes a first supporting frame member 1, a second supporting frame member 2, a pair of mounting seats 13, a handle 3, and a pair of rocking means 4. The first supporting frame member 1 includes a first ground bar 11 and a pair of first supporting members 12 respectively, detachably attached to two ends of the first ground bar 11. In this embodiment, each first supporting member 12 has a hollow lower end, and the first ground bar 11 includes two tubular engaging members 111 for engaging with the first supporting members 12 by simple insertion. An upper end of each first supporting member 12 is securely attached to the associated mounting seat 13.

The handle 3 includes a pair of side beams 31 each having a first end 32 detachably connected to a member 132 (see FIG. 2) of the associated mounting seat 13 by screws (not labeled) extending through holes (not labeled) defined in the first end 32 and holes 133 defined in the member 132. Each side beam 31 further includes a reduced second end 311, and a substantially U-shaped member 33 is detachably connected to the second ends 311 of the side beams 31 at two ends thereof, thereby forming the handle 3.

The second supporting frame member 2 includes a second ground bar 21 and a pair of second supporting members 22 respectively, detachably attached to two ends of the second ground bar 21. In this embodiment, each second supporting member 22 has a hollow lower end, and the second ground bar 21 includes two tubular engaging members 211 for engaging with the second supporting members 22 by simple insertion. An upper end of each second supporting member 22 is detachably attached to the associated mounting seat 13 by bolts (not labeled) extending through holes (not labeled) defined in the upper end of the second supporting member 22 and holes 131 defined in the associated mounting seat 13.

Each mounting seat 13 may comprise two interconnected plates (not labeled), and a receiving tube 134 is securely mounted between the plates for mounting the associated rocking means 4. Each mounting seat 13 further includes a positioning hole 135 which will be described later.

Each rocking means 4 includes a rocking rod 41 having a pedal 411 detachably mounted to a lower end thereof and an engaging tube 412 mounted to an upper end thereof. The engaging tube 412 includes a through hole 413. Two washers 414 are respectively mounted to two ends of the engaging tube 412 to reduce friction during rocking movements of the latter.

An axle tube 42 is partially extended through the engaging tube 412 and the sleeve 46 and has a first end 421 having a diameter greater than an inner diameter of the sleeve 46 (which is received in the associated receiving tube 134, see FIG. 3) and a second end which extends beyond the sleeve 46 and to which a nut 48 is mounted, as shown in FIG. 3. Referring to FIGS. 2 and 3, the first end 421 of the axle tube 42 includes a recess 422 for receiving a head of a bolt 43 and a longitudinal through hole 423 through which a stem of the bolt 43 extends. The axle tube 42 further includes a positioning pin 424 extending therefrom for engaging with the positioning hole 135 in the associated mounting seat 13, thereby preventing rotational movements of the axle tube 42.

As shown in FIG. 3, the first end 421 of the axle tube 42 further includes a transverse hole 425, and the bolt 43 includes a corresponding screw hole 431, and a screw 50 is extended through the holes 425 and 431 to position the bolt 43. As shown in FIG. 3, a spring 44 and a washer 45 are received in a chamber 461 defined by the sleeve 46 which includes an end wall 462 to which an end of the spring 44 bears against. The other end of the spring 44 is attached to the axle tube 42. Still referring to FIG. 3, a knob 49 having an engaging recess 491 is mounted to the nut 46 to rotate therewith. Under rotation of the knob 49, a torsion of the spring 44, an axial compressive force exists between the axle tube 42 and the engaging tube 412 of the rocking rod 41, as well as a rocking resistance of the rocking rod 41 can be adjusted.

In assembly, referring to FIGS. 2 and 3, the sleeve 46 is fittingly received in the receiving tube 134 of the mounting seat 13, and the washer 462 and the spring 45 are received in the sleeve 46. The axle tube 42 is extended through the engaging tube 412, in which the washers 414 are respectively mounted to two sides of the engaging tube 412. The engaging tube 412 is then aligned with the sleeve 46 and thus allows partial insertion of the axle tube 42 into the sleeve 46. Thereafter, the bolt 43 is inserted through the axle tube 42 and the sleeve 46 with the second end thereof extending beyond the sleeve 46. The nut 48 is mounted to the second end of the bolt 43 after a washer 47 is applied. The screw 50 is extended through the holes 425 and 431 to position the bolt 43. It is appreciated that the positioning pin 424 engages with the positioning hole 135 of the mounting seat 135, as described above. The knob 49 is then mounted to the nut 48 to rotate therewith, thereby providing an adjusting function mentioned above.

By such an arrangement, it is appreciated that the walking-type exerciser can be detached when not in use, which is convenient to storage and transportation. In addition, the resistance of the rocking rods can be adjusted to meet the user's need.

Operation of the walking-type exerciser of the present invention is the same as a conventional walking-type and therefore not further described.

Preferably, a wheel means, such as casters 112, may be provided to one of the first and second supporting frame member 2 for easy transportation. In addition, a timer and a counter may be used to calculate the time and the number of the steps when using the exerciser.

Although the invention has been explained in relation to its preferred embodiment, it is to be understood that many other possible modifications and variations can be made without departing from the spirit and scope of the invention as hereinafter claimed.

What is claimed is:

1. A walking-type exerciser, comprising:

two mounting seats each including a receiving tube and a positioning hole;

a first supporting frame member including a first ground bar having two ends and a pair of first supporting members respectively, detachably attached to the two ends of the first ground bar at lower ends thereof, each said first supporting member further including an upper end securely attached to the associated mounting seat;

a second supporting frame member including a second ground bar having two ends and a pair of second supporting members respectively, detachably attached to the two ends of the second ground bar at lower ends thereof, each said second supporting member further including an upper end detachably attached to the associated mounting seat;

a handle including a pair of side beams each having a first end detachably attached to the associated mounting seat and a second end, the handle further including a substantially U-shaped member having two ends respectively, detachably connected to the second ends of the side beams; and two rocking means each including:

a sleeve fittingly received in the receiving tube of the associated mounting seat, the sleeve including an end wall;

a rocking rod having a pedal detachably mounted to a lower end thereof, the rocking rod further including an engaging tube mounted to an upper end thereof, the engaging tube being mounted juxtaposed to and in alignment with the sleeve;

an axle tube extending through said engaging tube and said sleeve, said axle tube including a first end having a diameter greater than an inner diameter of the sleeve and a second end received in the sleeve, the first end of said axle tube including a recess defined therein, the axle tube further including a longitudinal through hole;

a bolt extending through the axle tube and having a first end and a second end, the second end of the bolt extending beyond the second end of the sleeve, the bolt having a head received in the recess of the axle tube;

a spring mounted in the sleeve and around the bolt, the spring having a first end bearing against the second end of the axle tube and a second end bearing against the end wall of the sleeve;

a positioning pin extending from the axle tube and having an end received in the positioning hole of the associated mounting seat to prevent rotational movement of the axle tube; and a nut mounted to the second end of the bolt, whereby a rotation of said nut causes a change in a resistance of the rocking means.

2. The walking-type exerciser according to claim 1, further comprising a knob mounted to each said nut to rotate therewith.

3. The walking-type exerciser according to claim 1, further comprising a washer mounted between each said nut and the end wall of the associated sleeve.

4. The walking-type exerciser according to claim 1, further comprising a washer mounted between each said spring and the end wall of the associated sleeve.

5. The walking-type exerciser according to claim 1, further comprising a pair of washers respectively mounted to two sides of each said axle tube.

6. The walking-type exerciser according to claim 1, further comprising means for positioning the bolt, the positioning means including a screw, a transverse hole defined in the transverse tube, and a corresponding screw hole defined in the bolt, the screw extending through the transverse hole and the screw hole to position the bolt.

* * * * *